US010589890B2

(12) United States Patent
Nille

(10) Patent No.: US 10,589,890 B2
(45) Date of Patent: Mar. 17, 2020

(54) CONTAINER AND METHOD FOR PRODUCING A CONTAINER

(71) Applicant: Peter Nille, Goeppingen-Jebenhausen (DE)

(72) Inventor: Peter Nille, Goeppingen-Jebenhausen (DE)

(73) Assignee: PTM PACKAGING TOOLS MACHINERY PTE. LTD., Singapore (SG)

( * ) Notice: Subject to any disclaimer, the term of this patent is extended or adjusted under 35 U.S.C. 154(b) by 61 days.

(21) Appl. No.: 15/381,659

(22) Filed: Dec. 16, 2016

(65) Prior Publication Data

US 2017/0174385 A1 Jun. 22, 2017

(30) Foreign Application Priority Data

Dec. 17, 2015 (DE) ..... 10 2015 225 799

(51) Int. Cl.

| | |
|---|---|
| ***B65D 3/14*** | (2006.01) |
| ***B21D 22/02*** | (2006.01) |
| ***B21D 51/26*** | (2006.01) |
| ***B65D 3/04*** | (2006.01) |
| ***B65D 3/28*** | (2006.01) |

(Continued)

(52) U.S. Cl.

CPC ..... *B65D 3/14* (2013.01); *B21D 22/02* (2013.01); *B21D 51/26* (2013.01); *B31B 50/743* (2017.08); *B31F 1/0032* (2013.01); *B65D 3/04* (2013.01); *B65D 3/28* (2013.01); *B31B 2105/0022* (2017.08); *B31B 2110/20* (2017.08)

(58) Field of Classification Search

CPC ... B65D 3/14; B65D 3/04; B65D 3/28; B21D 22/02; B21D 51/26; B29C 66/1282

USPC ..... 229/4.5, 198.2, 5.6, 93; 493/108

See application file for complete search history.

(56) References Cited

U.S. PATENT DOCUMENTS

| | | | |
|---|---|---|---|
| 3,242,829 | A | 3/1966 | White |
| 4,934,591 | A | 6/1990 | Bantleon |

(Continued)

FOREIGN PATENT DOCUMENTS

| | | | |
|---|---|---|---|
| CN | 2769188 | Y | 4/2006 |
| CN | 201254311 | Y | 6/2009 |

(Continued)

OTHER PUBLICATIONS

Search Report of European Patent Office issued in Application No. 16 20 3883 with English translation of category of cited documents dated Apr. 11, 2017 (8 pages).

(Continued)

*Primary Examiner* — Christopher R Demeree

(74) *Attorney, Agent, or Firm* — Flynn Thiel, P.C.

(57) ABSTRACT

A container of paper or paper-like material, having a sleeve and having a bottom and/or a cover, wherein the bottom and/or cover and the sleeve are connected in substantially liquid-tight fashion in the region of a bottom skirt and/or cover skirt. The sleeve is composed of a sheetlike blank, and wherein regions adjoining a first side edge and adjoining a second side edge, situated opposite the first side edge, of the blank are laid one on top of the other so as to form an overlapping side seam and connected to one another by material-bonding engagement, wherein at least the region adjoining the first side edge forms a step which is offset relative to the rest of the blank.

20 Claims, 7 Drawing Sheets

(51) Int. Cl.

| | |
|---|---|
| ***B31F 1/00*** | (2006.01) |
| ***B31B 50/74*** | (2017.01) |
| *B31B 110/20* | (2017.01) |
| *B31B 105/00* | (2017.01) |

(56) References Cited

U.S. PATENT DOCUMENTS

| | | | | |
|---|---|---|---|---|
| 5,622,308 | A | 4/1997 | Ito et al. | |
| 6,076,728 | A * | 6/2000 | Cahill | B31C 3/00 229/4.5 |
| 6,085,970 | A * | 7/2000 | Sadlier | B65D 3/22 229/198.2 |
| 7,112,356 | B2 * | 9/2006 | Nomula | B65D 3/22 428/34.1 |
| 9,758,292 | B2 * | 9/2017 | Leser | B65D 3/14 |

FOREIGN PATENT DOCUMENTS

| | | | |
|---|---|---|---|
| DE | 2 243 958 | A1 | 3/1974 |
| FR | 2 459 724 | A1 | 1/1981 |
| GB | 511843 | | 8/1939 |
| GB | 2 055 743 | A | 3/1981 |
| JP | 7-195584 | A | 8/1995 |
| JP | 2004-231197 | A | 8/2004 |
| JP | 2010-215249 | A | 9/2010 |
| JP | 2014-141282 | A | 8/2014 |
| WO | 03/106277 | A1 | 12/2003 |

OTHER PUBLICATIONS

Chinese Office Action issued in Appln. No. 201611165950.5 dated Feb. 28, 2019.

* cited by examiner

CONTAINER AND METHOD FOR PRODUCING A CONTAINER

CROSS-REFERENCE TO RELATED APPLICATIONS

This claims priority from German Patent Application No. 10 2015 225 799.1, filed on Dec. 17, 2015, the disclosure of which is hereby incorporated by reference in its entirety into this application.

FIELD, BACKGROUND AND SUMMARY OF THE INVENTION

The invention relates to a container composed of paper or paper-like material, having a sleeve and having a bottom and/or a cover, wherein the bottom and/or cover and the sleeve are connected in substantially liquid-tight fashion in the region of a bottom skirt and/or cover skirt respectively, wherein the sleeve is composed of a sheetlike blank, and wherein regions adjoining a first side edge and adjoining a second side edge, situated opposite the first side edge, of the blank are laid one on top of the other so as to form an overlapping side seam and connected to one another by material-bonding engagement.

With the invention, it is sought to improve a container, and a method for producing a container, in particular with regard to the sealing action of the overlapping side seam.

According to the invention, for this purpose, a container having the features of claim 1 and a method for producing a container having the features of claim 12 are provided. The subclaims specify advantageous embodiments of the invention.

In the case of a container according to the invention composed of paper or paper-like material, having a sleeve and having a bottom and/or a cover, the bottom and the sleeve are connected in substantially liquid-tight fashion in the region of a bottom skirt, and the cover and the sleeve are connected in substantially liquid-tight fashion in the region of a cover skirt. The sleeve is composed of a sheetlike blank, and regions adjoining a first side edge and adjoining a second side edge, situated opposite the first side edge, of the blank are laid one on top of the other so as to form an overlapping side seam and connected to one another by material-bonding engagement, e.g. cohesively connected. At least in the region of the bottom skirt and/or of the cover skirt, at least the region adjoining the first side edge forms a step which is offset relative to the rest of the blank.

Through the provision of an offset step in the region adjoining the first side edge, the offset formed by the overlapping side seam can be reduced in terms of its height, possibly even entirely levelled on one side. This facilitates the formation of the bottom skirt and of the cover skirt, respectively, in the region of the overlapping side seam, and in particular the liquid-tight form of the bottom skirt and of the cover skirt, respectively, in the region of the overlapping side seam. The step is advantageously formed, or the sleeve is advantageously produced from the sheetlike blank, such that the offset at the overlapping side seam is reduced in height, or entirely levelled, on the inner side of the sleeve. In this way, it is then possible, in the region of the bottom collar, for the encircling collar of the bottom and, in the region of the cover skirt, for the encircling collar of the cover, to be connected reliably and in liquid-tight fashion to the sleeve, specifically also in the region of the overlapping side seam, because there, there is merely a offset of reduced height, or even no longer an offset at all. In the context of the invention, the same design may be provided in the region of a cover skirt. If appropriate, it may be expedient for the offset step to be formed over the entire length of the side edge. In any case, the sleeve is formed from paper or paper-like material, which may be coated. The bottom and/or the cover may be composed of paper or paper-like material, which is possibly coated, or else from other materials, for example aluminium.

In an embodiment of the invention, the step has an offset and a step surface which extends from the offset to the first side edge, wherein the region adjoining the second side edge lies on the step surface, and the second side edge bears against the offset.

A further problem in the production of a container from a sleeve with an overlapping side seam consists in that, in the case of conventional containers, the face side of the inner side edge comes into contact with the liquid during the filling of the cup. In the case of cups composed of coated paper, the cut edge forming the face side is inevitably not coated unless additional measures are implemented in order to also coat the face side of the side edge. In general, this can be tolerated in the case of paper cups, because paper cups are indeed generally used only once. There are however by all means situations in which the ingress of liquid via the face side of the inner side edge is disruptive, and poses a risk to the sealing action of the overlapping side seam. This may be the case specifically with hot beverages, for example. By virtue of the fact that, now, the region adjoining the second side edge lies on the step surface and the second side edge lies against the offset, the face side of the second side edge can be sealed off, because it now bears against the offset of the step. The face side of the second side edge thus no longer lies unprotected in the interior space of the container. During the connection by material-bonding engagement of the region adjoining the second side edge to the step surface, it is for example possible for a greater amount of adhesive to be applied in the region of the offset of the step in order to close off or seal off the face side of the second side edge in liquid-tight fashion. The second side edge expediently lies on the inner side of the sleeve, such that the region adjoining the second side edge comes into contact with the liquid during the filling of the container.

In an embodiment of the invention, a sealing strip is laid around the second side edge, which sealing strip is connected by material-bonding engagement to the sheetlike blank.

In this way, the face surface of the second side edge can be reliably sealed off against an ingress of liquid.

In an embodiment of the invention, the second side edge is covered, toward the interior space of the container, with a sealing strip which is connected by material-bonding engagement to the inner side of the container.

For example, after production of the overlapping side seam on the sleeve, a sealing strip is applied to the inner side of the sleeve, which sealing strip then covers the gap that may possibly still be present between the face surface of the second side edge and the offset of the step in the region of the first side edge. In this way, the overlapping side seam can be completely sealed off toward the inner side of the sleeve.

In an embodiment of the invention, the region adjoining the second side edge is folded over through 180°, such that a section with two material layers lying one on top of the other is formed, which section forms a new side edge of the blank.

Normally, paper or paper-like material used for producing containers is coated at least on one side, such that liquid is prevented from ingressing into the paper or paper-like material. Often, the coating is applied only on one side not for cost reasons alone. This is the case inter alia also because it is generally sought to apply a print to the outer side, which does not come into contact with liquid, of the sleeve. Here, a coating would merely be a hindrance. By virtue of the fact that, now, the region adjoining the second side edge is folded over through 180°, a new side edge of the blank is formed, at which the coating is then likewise provided. If said new side edge of the blank is now, during the formation of the overlapping side seam of the sleeve, arranged on the inner side of the sleeve, said new side edge is reliably protected, by the coating, against the ingress of liquid.

In an embodiment of the invention, the material thickness of the region adjoining the second side edge is reduced in relation to the rest of the blank.

In the case of the region adjoining the second side simply being folded over through 180°, a region of twice the material thickness in relation to the rest of the blank is realized. This effect can be lessened by reducing the material thickness of the region adjoining the second side edge in relation to the rest of the blank. For example, the region adjoining the second side edge may be milled down to the reduced material thickness. Specifically in the case of paper or paper-like material, the milling of a sheetlike blank in the region of the side edge is possible in a simple manner which is reliable in terms of a process.

A thickness of the section with two material layers lying one on top of the other advantageously corresponds to a material thickness of the rest of the blank.

In this way, a constant material thickness of the sheetlike blank is realized, and at the same time, by virtue of the region adjoining the second side edge being folded over through 180°, a new side edge of the blank can be provided, at which a coating is then provided.

In an embodiment of the invention, the region adjoining the second side edge forms an offset second step, wherein the two steps on the finished container extend in different directions as viewed in a radial direction.

Through the provision of a step both at the region adjoining the first side edge and at the region adjoining the second side edge, it is possible, both on the inner side and on the outer side of the sleeve, to realize an offset with reduced height in the region of the overlapping side seam. For example, on the inner side of the sleeve, an offset height is set which makes it possible to realize a reliable and liquid-tight connection of the sleeve to the bottom in the region of the bottom skirt and/or to the cover in the region of the cover skirt. On the outer side of the sleeve, a height of the offset is set which ensures an aesthetic appearance of the cup and which is for example also comfortable for a user from a haptic aspect.

In an embodiment of the invention, the first and the second step have in each case one offset and one step surface which extends from the offset to the first side edge, wherein a height of the offset of the first and of the second step corresponds in each case to half of the material thickness of the blank.

In this way, both on the inner side of the sleeve and on the outer side of the sleeve, in the region of the overlapping side seam, in each case one offset can be provided which has merely the height of half of the material thickness of the blank.

In an embodiment of the invention, the step has an offset at the transition from the step to the rest of the blank, wherein a height of the step corresponds to the material thickness of the paper or of the paper-like material.

In the case of such an embodiment of the step in the region of the first side edge, it is possible on one side of the blank, expediently on the inner side of the sleeve, for the region of the overlapping side seam to be formed without an offset. As has already been stated, this firstly permits the reliable liquid-tight formation of the bottom skirt and/or cover skirt at which the bottom and/or cover is connected in liquid-tight fashion to the sleeve, and simultaneously permits the sealing of the face side of the second side edge with respect to liquid in the interior of the container.

In a method according to the invention for producing a container, the following steps are provided: forming a step, which is offset relative to the rest of the blank, at a region adjoining the first side edge, placing a region adjoining the second side edge onto a step surface of the step and placing the second side edge against an offset of the step.

In this way, on an inner side of the sleeve, the region of the overlapping side seam can be formed without an offset. By virtue of the second side edge being placed against an offset of the step, the face surface of the second side edge can be at least partially sealed off.

In an embodiment of the invention, the stamping of the step is performed by way of a punch.

Alternatively, the stamping of the step may be performed by way of a roller.

In an embodiment of the invention, the following steps are provided: milling a region adjoining the second side edge of the blank to a reduced material thickness, and folding over the region adjoining the second side edge through 180°, such that a section with two material layers of in each case reduced material thickness lying one on top of the other is formed, which section forms a new side edge of the blank.

In this way, it can be achieved that the new side edge of the blank is equipped with a coating and is thereby protected against an ingress of liquid. Furthermore, it is achieved that the folded-over region does not have twice the material thickness of the blank, but rather has merely a reduced material thickness in relation thereto, ideally the same material thickness as the rest of the blank. For this purpose, it is then necessary for the region adjoining the second side edge of the blank to be milled to half of the material thickness.

Further features and advantages of the invention will emerge from the claims and from the following description of preferred embodiments of the invention in conjunction with the drawings. Here, individual features of the various embodiments illustrated in the drawings and described may be combined with one another in any desired manner without departing from the scope of the invention. In the drawings:

DETAILED DESCRIPTION

Figure 1:
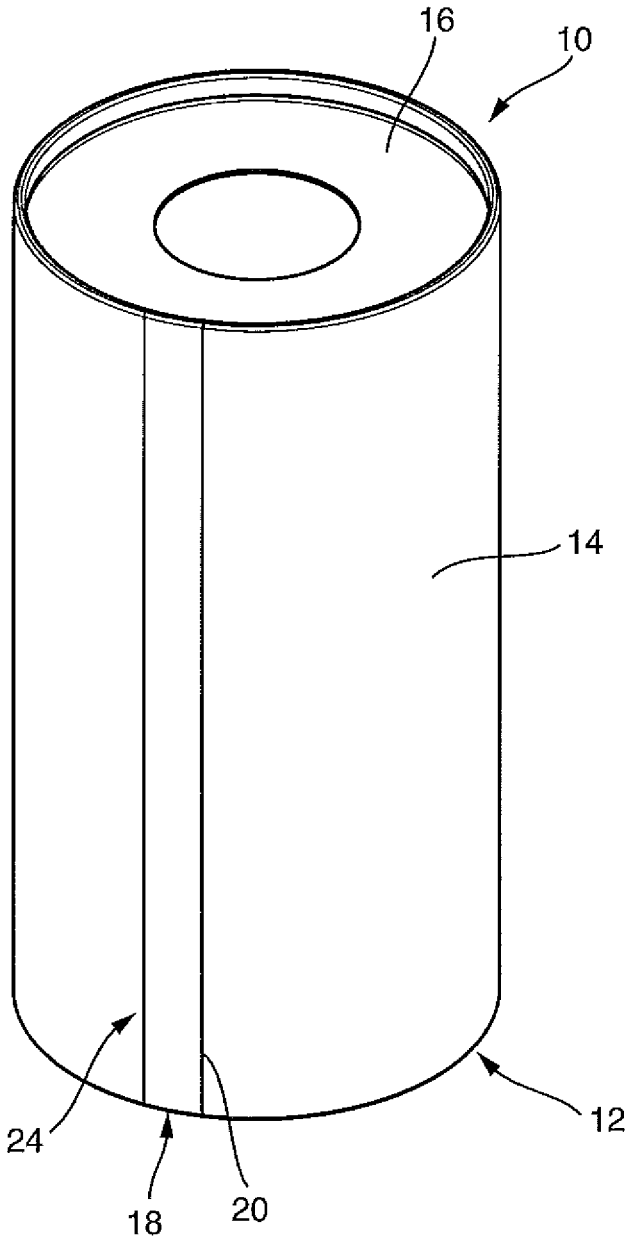
FIG. 1 shows a view of a container according to the invention according to a first embodiment obliquely from above.

FIG. 1 shows a container 10 according to the invention as per a first embodiment. The container has a bottom 12 which is not visible in FIG. 1, a sleeve 14 and a cover 16. The sleeve 14 is wound from a sheetlike blank composed of paper or paper-like material, wherein, for the connection of the first and the second side edge of the sheetlike blank, an overlapping side seam 18 is formed. For the formation of the overlapping side seam 18, a region adjoining a first side edge 20 is laid over a region adjoining a second side edge that is not visible in FIG. 1, and said two regions are then connected to one another by material-bonding engagement, e.g. by hot sealing a plastic coating of the paper, the paper-like material or by the use of adhesive. It is already indicated in FIG. 1 that a region adjoining the first side edge 20 forms a step 24 which is offset in relation to the rest of the blank. This will be discussed in more detail below.

The bottom 12 and the cover 16 are each of pot-shaped form and have a substantially planar bottom or cover surface respectively and an encircling cover collar or bottom collar respectively projecting perpendicularly from the cover surface or bottom surface respectively. A top edge and a bottom edge respectively of the sleeve 14 are folded over through 180° around said cover collar and bottom collar respectively. In this way, as will be discussed in more detail below, a so-called cover skirt and bottom skirt respectively are formed, by way of which the sleeve can be connected in substantially liquid-tight fashion to the cover and to the bottom respectively.

The formation of the bottom skirt in the region of the overlapping side seam 18 is critical for the sealing action of the container. The provision of the step 24 provides assistance in this regard, and a considerable improvement is achieved with regard to the sealing action of the container 10. The step 24 may also, in the context of the invention, be provided in the region of the cover skirt, and in particular, the cup may be of substantially identical form in the region of the bottom skirt and in the region of the cover skirt.

Both the bottom 12 and the cover 16 are of circular form, and the sleeve 14 has a circular cylindrical shape.

The invention is however not restricted to a particular shape of the container 10, and may for example also be used for containers which are open on one side, so-called cups, with a possibly frustoconical sleeve.

Figure 2:
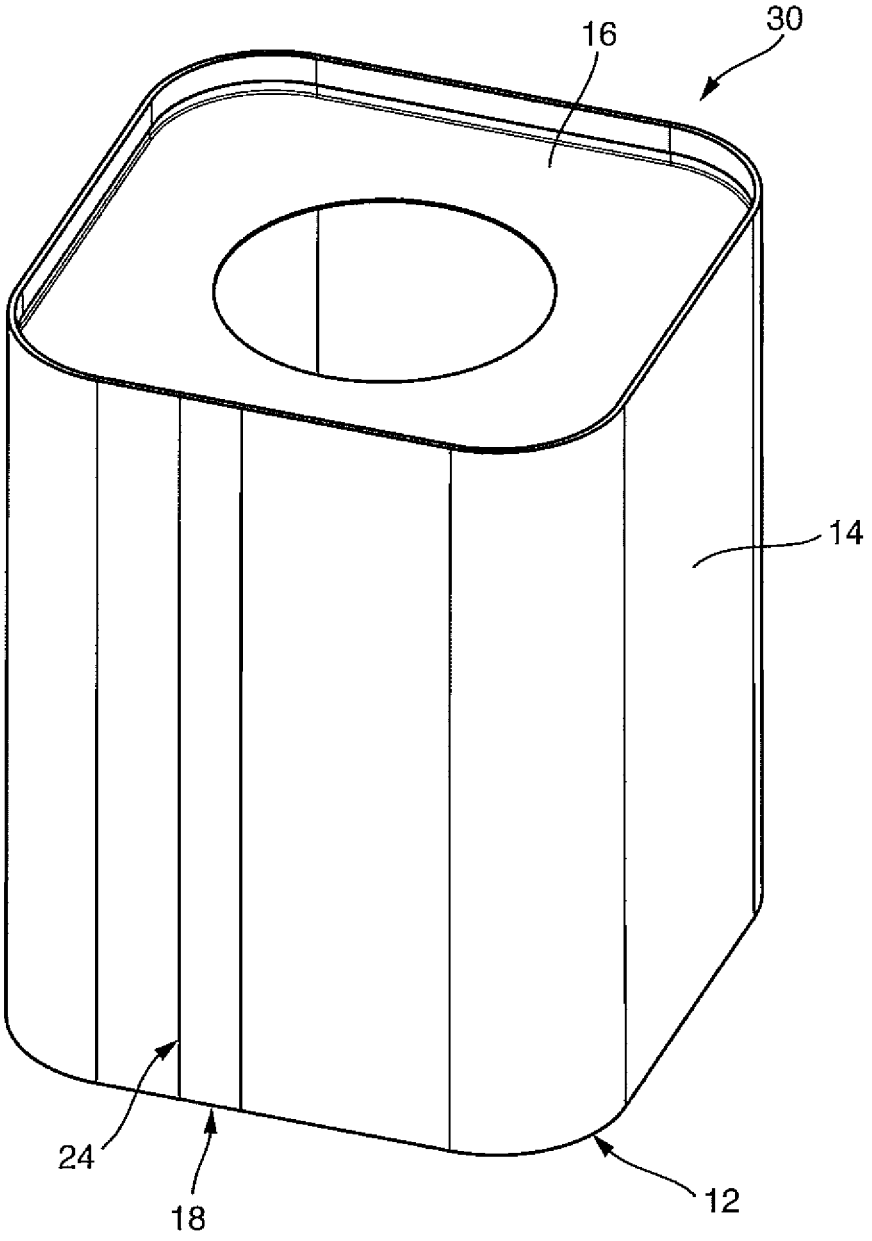
FIG. 2 shows a further embodiment of a container according to the invention obliquely from above.

FIG. 2 shows a further embodiment of a container 30 according to the invention. The container 30 has a cylindrical shape with the outline of a rectangle with rounded corners. Otherwise, the container 30 is of identical construction to the container 10 of FIG. 1, and in particular likewise has a sleeve 14, a bottom 12, a cover 16. The sleeve 14 has an overlapping side seam 18 which forms a step 24 on the outer side of the container.

Figure 3:
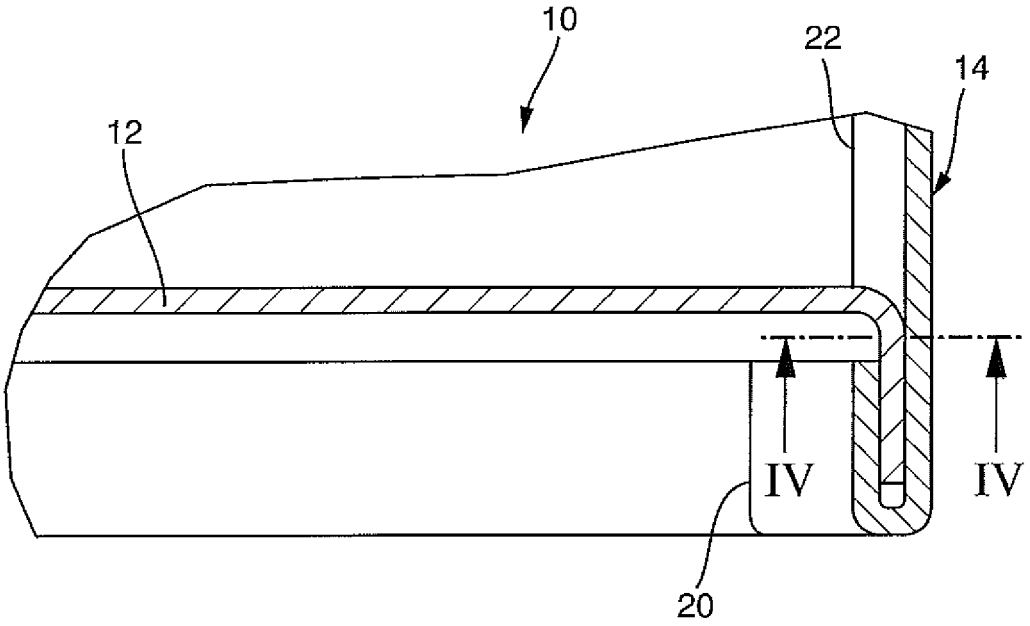
FIG. 3 shows a detail sectional view of the container of FIG. 1.

The illustration of FIG. 3 shows a detail sectional view of the container 10 of FIG. 1. It is possible to see the bottom 12 of pot-shaped form, which bottom has a bottom collar projecting perpendicularly downward from a bottom plate. A region adjoining the lower edge of the sleeve 14 is folded over through 180° around said bottom collar. In this way, with the region adjoining the lower edge of the sleeve 14, a U-shaped pocket is formed in which the bottom collar is received. The bottom collar is then pressed together with the U-shaped pocket of the sleeve 14, and is for example at the same time cohesively connected by material-bonding engagement to the material of the sleeve 14, e.g. by hot sealing or by using adhesive, such that the sleeve 14 and the bottom 12 are connected to one another in substantially liquid-tight fashion in the region of the bottom skirt.

In FIG. 3, it is possible to see the second side edge 22 of the sheetlike blank, which second side edge lies on the inner side of the container or of the sleeve 14. The first side edge 20 lies on the outer side of the sleeve 14, see FIG. 1, and, in the illustration of FIG. 3, can be seen only in the folded-over lower region of the sleeve 14, which forms part of the bottom skirt.

Figure 4:
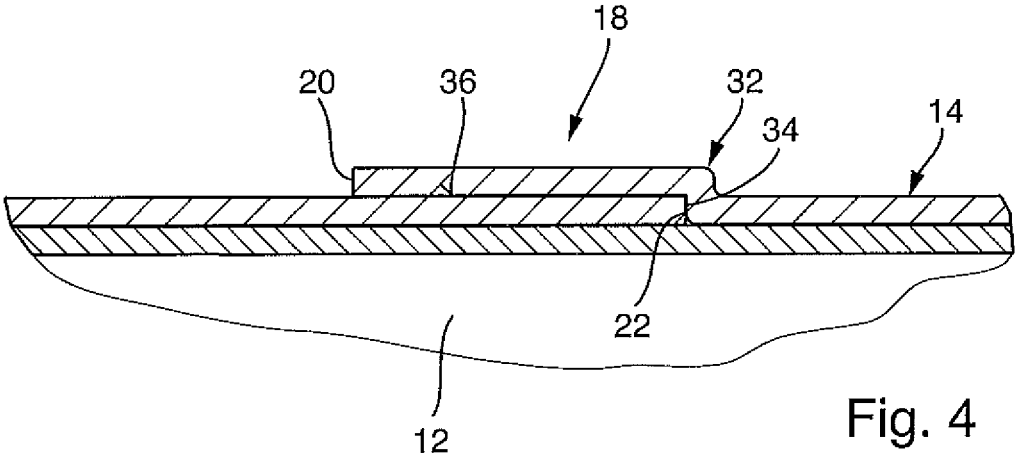
FIG. 4 shows a detail view onto the section plane IV-IV in FIG. 3.

The illustration of FIG. 4 shows a view onto the section plane IV-IV in FIG. 3. The section plane IV-IV extends through the bottom collar of the bottom 12 and shows the region of the overlapping side seam 18 of the sleeve 14.

It can be seen that a region adjoining the first side edge 20 forms a step 32 which is offset in relation to the rest of the blank from which the sleeve 14 is produced. The step 32 has an offset 34 and a step surface 36. A region, adjoining the second side edge 22, of the sheetlike blank from which the sleeve 14 is produced lies on the step surface 36, and the second side edge 22 lies on the offset 34 of the step 32.

The offset 34 is dimensioned in terms of its height so as to correspond to the material thickness of the sheetlike blank from which the sleeve 14 is produced. In this way, an offset is no longer formed on the inner side of the sleeve 14, which lies against the bottom collar of the bottom 12. The inner side of the sleeve 14 is thus formed without an offset or step, and can thereby be reliably connected in liquid-tight fashion to the bottom collar of the bottom 12.

The formation of the step in the region adjoining the first side edge 20 thereby offers considerable advantages with regard to the formation of the bottom skirt. In the same way, the provision of said step offers the same advantages with regard to the formation of the cover skirt.

Further advantages are achieved by way of the invention with regard to a sealing action of the second side edge 22 with respect to a liquid situated in the interior space of the container, as will be discussed below on the basis of FIGS. 5 and 6.

Figure 5:
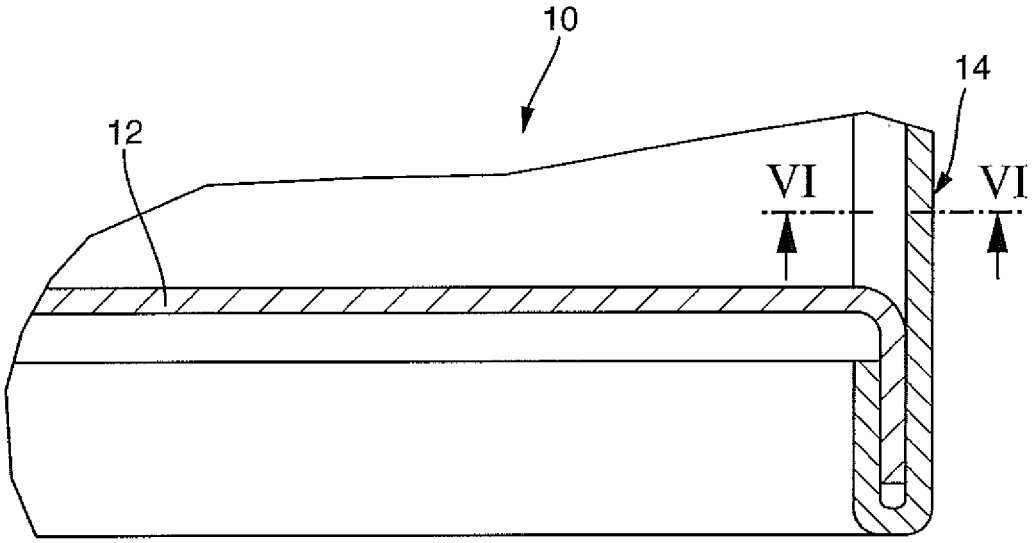
FIG. 5 shows a detail sectional view, corresponding to the view of FIG. 3, of the container of FIG. 1.

FIG. 5 shows the same partial sectional view of the container 10 of FIG. 1. The section plane VI-VI however lies above the bottom 12. The section plane VI-VI therefore extends through a region of the sleeve 14 arranged above the bottom 12.

Figure 6:
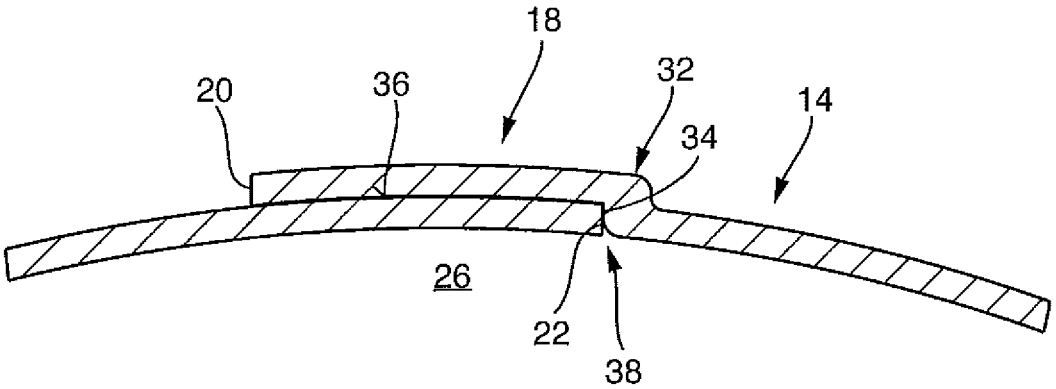
FIG. 6 shows a detail view onto the section plane VI-VI in FIG. 5.

A detail view onto the section plane VI-VI in FIG. 5 is illustrated in FIG. 6. It is possible to see a section of the sleeve 14 in the region of the overlapping side seam 18. The region adjoining the first side edge 20 forms the step 32 with the offset 34 and the step surface 36. The step 32 and the offset 34 extend outward in a radial direction. The first side edge 20 thus lies on the outer side of the sleeve 14. The second side edge 22 lies on the offset 34 of the step 32 and is thus, as can be seen from FIG. 6, already partially sealed off with respect to the interior space of the sleeve 14. By way of the configuration according to the invention, only a small gap 38 remains between the second side edge 22 and that region of the offset 34 which is directed toward the interior space of the sleeve. Said gap 38 is so small that it can be easily closed by adhesive or glue during the cohesive connection of the region adjoining the first side edge 20 to the region adjoining the second side edge 22 for the formation of the overlapping side seam 18. Also, in the region of the cover skirt and bottom skirt, see FIG. 4, an opening between the folded-over edge of the bottom 12 or of the cover respectively and the sleeve 14 at the location of the gap 38 is avoided. In this way, no liquid can ingress from the interior of the container between the folded-over edge of the bottom 12 and the sleeve 14.

In this way, the second side edge 22 can be reliably protected against an ingress of liquid.

This is generally necessary because the sheetlike blank from which the sleeve 14 is produced is generally coated. For cost reasons, and in order to make it possible for a print to be applied to the outer side of the sleeve 14, the coating is in this case applied only to an inner side of the sleeve 14. In any case, after the sheetlike blank has been cut out of a larger sheet of material, a coating is no longer present at the side edges. In the case of paper or paper-like material, it is then possible for liquid to ingress into the unprotected second side edge 22. According to the invention, this is reliably prevented by virtue of the second side edge 22 lying against the offset 34 of the step 32 and by virtue of a gap that remains being closed by way of adhesive, glue or else merely as a result of the sealing of the coatings in the region of the overlapping side seam 18.

Figure 7:
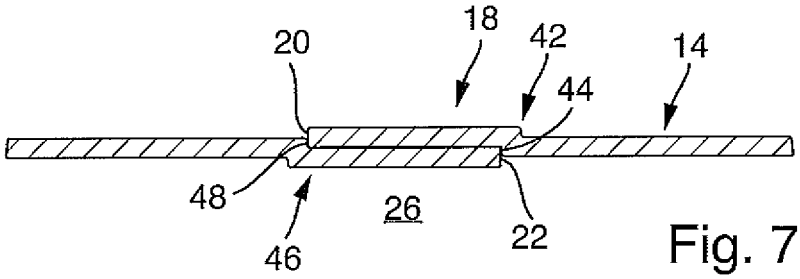
FIG. 7 shows a detail sectional view of a container according to the invention as per a further embodiment of the invention.

The illustration of FIG. 7 shows a further embodiment of the invention, in which, similarly to the view of FIG. 6, only the region of the overlapping side seam 18 of the sleeve 14 is illustrated.

In the embodiment in FIG. 7, the region adjoining the first side edge 20 again forms a step 42. The step 42 is however of lower form than the step 32 in FIG. 6. Specifically, the height of an offset 44 of the step 42 amounts to only half of the material thickness of the material from which the sleeve 14 is produced.

Furthermore, the region adjoining the second side edge 22 forms a further step 46. The step 46 also forms an offset 48 with a height that corresponds to half of the material thickness of the material of the sleeve 14.

In this way, both on the inner side and on the outer side of the sleeve 14, an offset remains at the first side edge 20 and the second side edge 22 respectively. The height of said offset however amounts to only half of the material thickness of the material of the sleeve 14. Sealing in the region of the bottom skirt thus remains possible in a reliable manner. The exposed region of the second side edge 22 is still small enough that it can be easily sealed off or such that liquid that may ingress can be tolerated. As in the illustration of FIG. 6, an interior space 26 of the sleeve 14 is situated at the bottom in FIG. 7.

Figure 8:
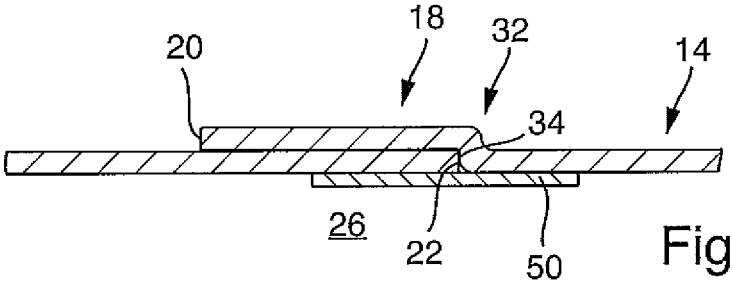
FIG. 8 shows a detail sectional view of a container as per a further embodiment of the invention.

The illustration of FIG. 8 shows a further embodiment of the invention, wherein again, only the region of the overlapping side seam 18 of the sleeve 14 is illustrated. An interior space 26 of the sleeve 14 is situated at the bottom in FIG. 8. The region adjoining the first side edge 20 forms the step 32, and, as has already been discussed with regard to FIG. 6, the region adjoining the second side edge 22 has been placed into the step 32. The remaining narrow gap between the second side edge 22 and the offset 34 of the step 32 is covered by way of a sealing strip 50. Said sealing strip 50 is, after the production of the overlapping side seam 18, connected to the inner side of the sleeve 14. This may be realized for example by virtue of the sealing strip 50 being melted together with the coating, facing toward the interior space 26, of the sleeve 14, or being sealed onto the inner side of the sleeve 14.

Figure 9:
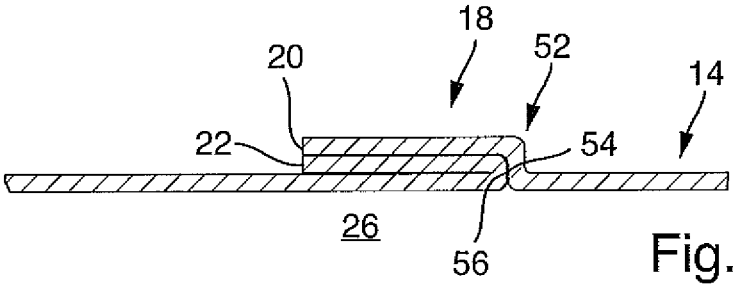
FIG. 9 shows a sectional view of a container as per a further embodiment of the invention.

The illustration of FIG. 9 shows a further embodiment of the invention. The illustration again shows only the region of the overlapping side seam 18. The sleeve 14 has a step 52 in the region adjoining the first side edge 20. The step 52 has an offset 54 which has a height corresponding to twice the material thickness of the blank from which the sleeve 14 is produced.

The region adjoining the second side edge 22 has been folded over through 180° and thereby forms a new side edge 56 of the blank from which the sleeve 14 is produced. Said new side edge 56 is laid against the offset 54 of the step 52. In this way, toward the interior space 26 of the sleeve 14, no offset is formed in the region of the overlapping side seam 18. At the same time, the new side edge 56 is protected against an ingress of liquid, because the region adjoining the second side edge 22 is folded over such that a coating facing toward the interior space 26 of the sleeve 14 is then also arranged on the new side edge 56.

Figure 10:
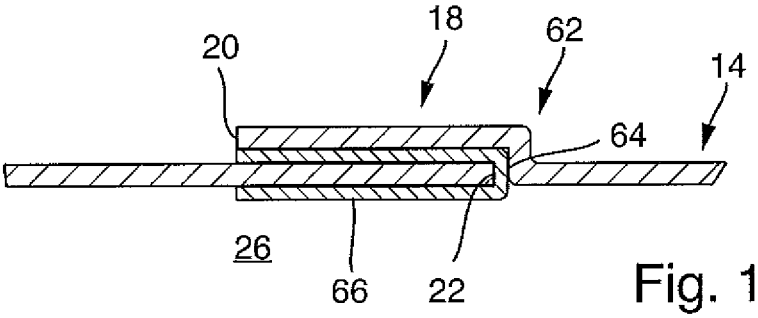
FIG. 10 shows a sectional view of a container as per a further embodiment of the invention.

The illustration of FIG. 10 shows a further embodiment of the invention, wherein again, only the region of the overlapping side seam 18 is illustrated.

The region adjoining the first side edge 20 forms a step 62. A sealing strip 64 has been folded over through 180° about the second side edge 22. The side edge 22 is thereby reliably protected against an ingress of liquid. The sealing strip 64 is at the same time used for connecting the region adjoining the second side edge 22 to the region adjoining the first side edge 20 in the region of the overlapping side seam 18, for example by way of a sealing-on action.

It can be seen in FIG. 10 that the offset 64 of the step 62 has a height smaller than the thickness of the blank plus twice the material thickness of the sealing strip 66. An offset toward the interior space 26 of the sleeve thus remains in the region of the second side edge 22.

Figure 11:
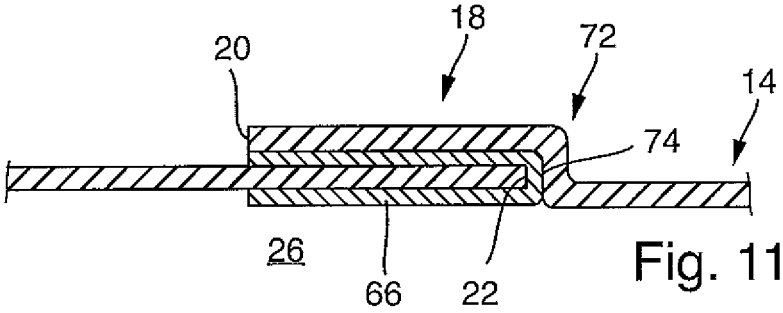
FIG. 11 shows a sectional view of a container as per a further embodiment of the invention.

In the embodiment of FIG. 11, said offset is no longer present, because there, an offset 74 of a step 72 is of a height exactly equal to the material thickness of the blank of the sleeve 14 plus twice the material thickness of the sealing strip 66.

Figure 12:
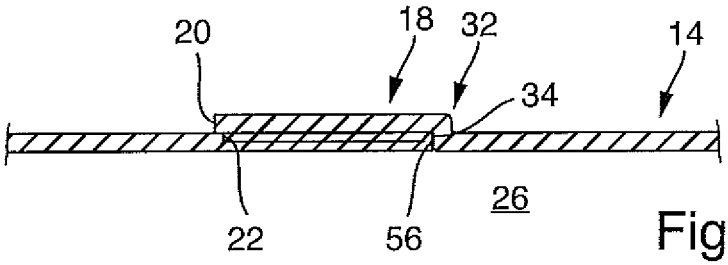
FIG. 12 shows a partial sectional view of a container as per a further embodiment of the invention.

The illustration of FIG. 12 shows a further embodiment of the invention, wherein again, only the region of the overlapping side seam 18 of the sleeve 14 is illustrated. The region adjoining the first side edge 20 again forms the step 32, which has an offset 34 of a height corresponding to the material thickness of the blank from which the sleeve 14 is produced.

The region adjoining the second side edge 22 has firstly been milled to half of its original material thickness and then folded over through 180°. In this way, a new side edge 56 of the blank is formed. In the folded-over region, there is now a material thickness which corresponds to the original material thickness of the blank. Nevertheless, the new side edge 56 is firstly protected by the coating of the blank on the side facing toward the interior space 26 of the sleeve 14. Secondly, the new side edge 56 lies against the offset 34 of the step 32. During the cohesive connection and production of the overlapping side seam 18, the new side edge 56 can thus also be connected with sealing action, or in cohesive fashion, to the offset 34.

Figure 13:
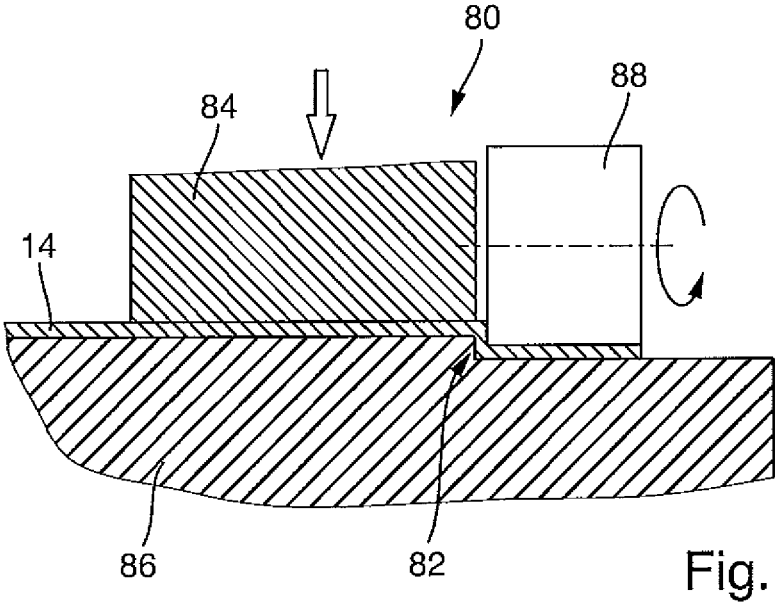
FIG. 13 is a schematic illustration of a device for producing the container according to the invention.

The illustration of FIG. 13 shows a device 80 for forming a step 82 into the blank for the sleeve 14. The blank is pressed by way of a punch 84 against a support 86 and is thereby held fixed. Then, by way of a roller 88, the step is rolled into the blank. The step 82 then follows a step-shaped contour of the support 86.

Figure 14:
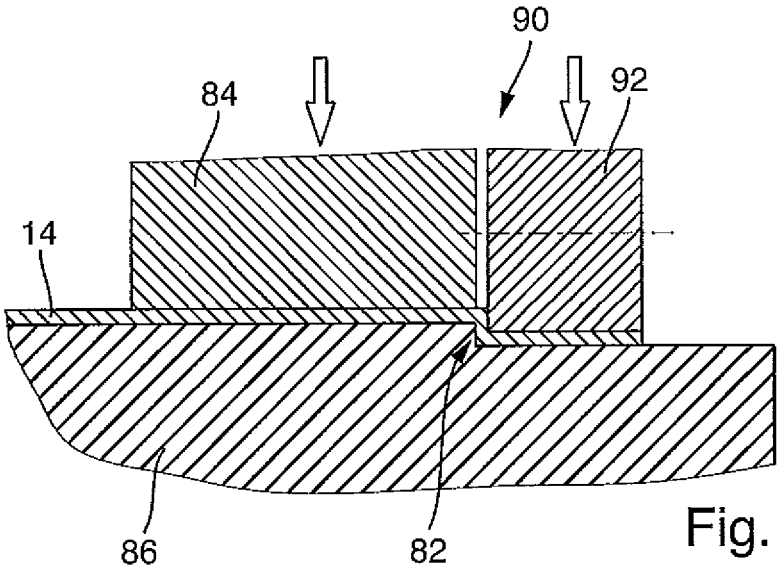
FIG. 14 is a schematic illustration of a further embodiment of a device for producing the container according to the invention.

The illustration of FIG. 14 shows a further device 90 for producing the step 82 in the blank for the sleeve 14. Again, the blank lies on the support 86, which has a step-shaped contour, and said blank is held on the support 86 by the punch 84. For the stamping of the step 82, a further punch 92 is provided which is placed against the support 86 with the blank for the sleeve 14 being positioned in between, and the step 82 is thereby stamped in.

Figure 15:
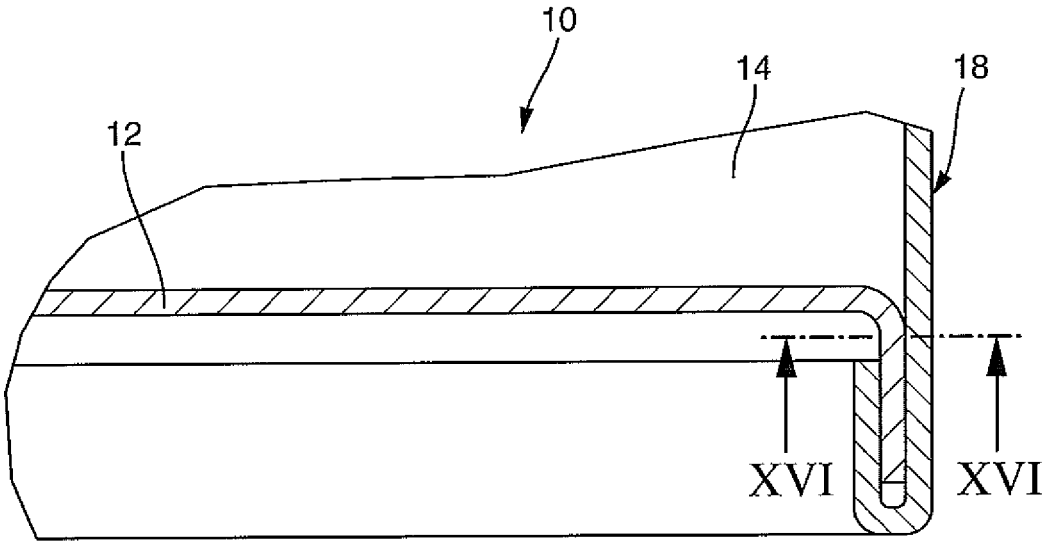
FIG. 15 is a detail sectional view of a further container according to the invention.

The illustration of FIG. 15 shows a detailed sectional view of a container 10 according to a further embodiment of the invention. The overlapping side seam 18 of the container is of the same form as that illustrated in FIG. 7.

Figure 16:
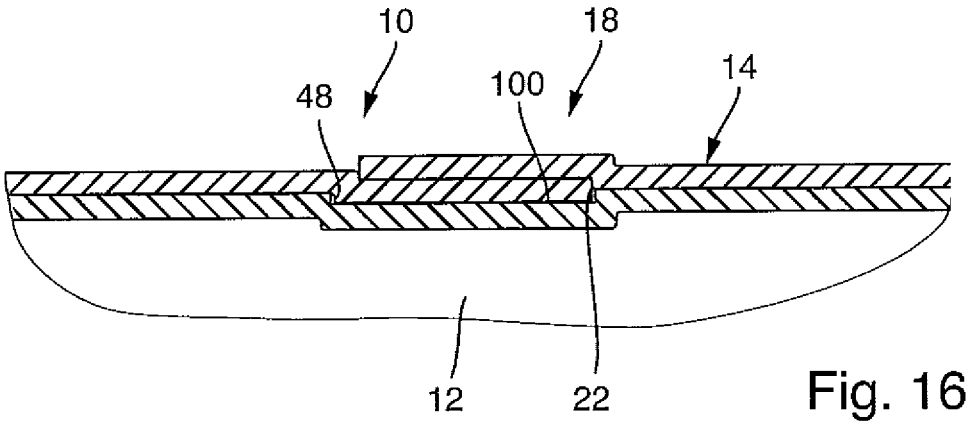
FIG. 16 is a detail view onto the section plane XVI-XVI in FIG. 15.

FIG. 16 shows a view onto the section plane XVI-XVI in FIG. 15. It is possible to see the bottom 12 in the region of the bottom skirt, only a detail of the bottom plate of which is illustrated, and the bottom collar illustrated in section, which bottom collar projects perpendicularly downward from the bottom plate, see also FIG. 15. As has already been mentioned, the overlapping side seam 18 is of identical form to the embodiment of FIG. 7, and will therefore not be discussed again. In the illustration of FIG. 16, an outer side of the container 10 is situated at the top, and an interior space of the container is situated at the bottom. It can be seen that the bottom collar has a stamped formation 100 which extends toward the inner side of the container 10 and which consequently forms a depression. The depression is adapted to the dimensions of that region of the overlapping side seam 18 which projects toward the inner side of the container, that is to say downward in FIG. 16. Specifically, the stamped formation 100 is as wide as the distance between the offset 48 and the side edge 22, cf. also FIG. 7. A depth of the stamped formation 100 corresponds to the height of the offset 48, and thus, in the embodiment illustrated, to half of the material thickness of the material of the sleeve 14.

The stamped formation 100 may be formed on the bottom collar of the bottom 12 either prior to the connection of the bottom 12 to the sleeve 14 or else during the connection of the bottom 12 to the sleeve 14. In any case, it can be seen that it is also the case in the region of the overlapping side seam 18 that, where the bottom collar lies against the overlapping side seam 18, only negligibly small intermediate spaces are present between the bottom collar and the inner side of the sleeve 14. This ensures a reliably liquid-tight connection of the bottom 12 to the sleeve 14.

In the same way as the bottom collar of the bottom 12, it is also possible for the cover collar of the cover 16 to be provided with a corresponding stamped formation 100. The cover skirt is in this case of identical form to the bottom skirt that has been discussed on the basis of FIGS. 15 and 16.

The embodiment of FIGS. 15 and 16 is advantageous in particular when it is combined with a sleeve 14 composed of paper material and a bottom 12 and/or a cover 16 composed of aluminium.

The invention claimed is:

1. Container composed of paper or paper-like material, having a sleeve and having a bottom and/or a cover, wherein the bottom and the sleeve are connected in substantially liquid-tight fashion in the region of a bottom skirt and/or the cover and the sleeve are connected in substantially liquid-tight fashion in the region of a cover skirt, respectively, wherein the sleeve is composed of a sheetlike blank, and wherein regions adjoining a first side edge and adjoining a second side edge, situated opposite the first side edge, of the blank are laid one on top of the other and bonded so as to form an overlapping side seam, wherein, at least in the region of the bottom skirt and/or of the cover skirt, at least the region adjoining the first side edge forms a step which is offset relative to the rest of the blank, wherein the bottom and/or the cover is of pot-shaped form and has a bottom collar and/or a cover collar, respectively, projecting perpendicularly from a bottom plate or a cover plate, respectively, wherein the bottom collar and/or the cover collar, respectively, is equipped with a radially inwardly extending stamped formation conforming to the dimensions of an inwardly projecting region of the overlapping side seam, wherein the radially inwardly extending stamped formation is arranged parallel to the overlapping side seam for receiving a portion of the overlapping side seam.

2. Container according to claim 1, wherein the step has an offset and a step surface which extends from the offset to the first side edge, wherein the region adjoining the second side edge lies on the step surface, and the second side edge bears against the offset.

3. Container according to claim 1, wherein a sealing strip is laid around the second side edge, the sealing strip being bonded to the sheetlike blank.

4. Container according to claim 1, wherein the second side edge is covered, toward the interior space of the container, with a sealing strip which is bonded to the inner side of the sleeve.

5. Container according to claim 1, wherein the region adjoining the second side edge is folded over through 180 degrees, such that a section with two material layers lying one on top of the other is formed, the section forming a new side edge of the blank.

6. Container according to claim 5, wherein the material thickness of the region adjoining the second side edge is reduced in relation to the rest of the blank.

7. Container according to claim 1, wherein, at least in the region of the bottom skirt and/or of the cover skirt, the region adjoining the second side edge forms an offset second step, wherein the two steps on the finished container extend in different directions as viewed in a radial direction.

8. Container according to claim 7, wherein the first and the second step have in each case one offset and one step surface which extends from the offset to the first or second side edge, respectively, wherein a height of the offset of the first and of the second step corresponds in each case to half of the material thickness of the blank.

9. Container according to claim 1, wherein the step has an offset at the transition from the step to the rest of the blank, wherein a height of the offset corresponds to the material thickness of the paper or of the paper-like material.

10. Container according to claim 1, wherein the bottom and/or the cover is composed of a metallic material or of a material which has a metal layer.

11. Method for producing the container according to claim 1, including forming the step, which is offset relative to the rest of the blank, at a region adjoining the first side edge at least in the region of the bottom skirt and/or cover skirt, placing a region adjoining the second side edge onto a step surface of the step and placing the second side edge against an offset of the step.

12. Method according to claim 11, including stamping the step with a punch or with a roller.

13. Method according to claim 11, including milling a region adjoining the second side edge of the blank to a reduced material thickness, and folding over the region adjoining the second side edge through 180 degrees, such that a section with two material layers of in each case reduced material thickness lying one on top of the other is formed, which section forms a new side edge of the blank.

14. Method according to claim 11, including forming the stamped formation on the bottom collar which projects perpendicularly from the bottom plate of the bottom and/or on the cover collar which projects perpendicularly from the cover plate of the cover, wherein the stamped formation is adapted to the dimensions of the inwardly projecting region of the overlapping side seam.

15. A container comprising:

a sleeve; and at least one end covering;

the sleeve and the at least one end covering being composed of paper or paper-like material;

the sleeve and the at least one end covering being connected in substantially liquid-tight fashion in a region of a skirt of the sleeve;

the sleeve being composed of a sheetlike blank;

the blank includes a first side edge and a second side edge situated opposite the first side edge;

the first side edge and the second side edge of the blank are laid one on top of the other and bonded so as to form an overlapping side seam;

the first side edge forming a step which is offset relative to the rest of the blank at least at the region of the skirt of the sleeve;

the at least one end covering comprising a plate and a collar projecting perpendicularly from the plate;

the collar includes an outer surface and a radially inwardly extending stamped formation extending inwardly from the outer surface, the radially inwardly extending stamped formation conforming to dimensions of an inwardly projecting region of the overlapping side seam to receive at least a portion of the inwardly projecting region of the overlapping side seam therein; and the radially inwardly extending stamped formation is only located at the overlapping side seam.

16. The container of claim 15, wherein:

the at least one end covering comprises a bottom cover.

17. The container of claim 16, wherein:

the at least one end covering further comprises a top cover.

18. The container of claim 15, wherein:

the at least one end covering comprises a top cover.

19. A container comprising:

a sleeve; and at least one end covering;

the sleeve and the at least one end covering being composed of paper or paper-like material;

the sleeve and the at least one end covering being connected in substantially liquid-tight fashion in a region of a skirt of the sleeve;

the sleeve being composed of a sheetlike blank;

the blank includes a first side edge and a second side edge situated opposite the first side edge;

the first side edge and the second side edge of the blank are laid one on top of the other and bonded so as to form an overlapping side seam;

the first side edge forming a step which is offset relative to the rest of the blank at least at the region of the skirt of the sleeve;

the at least one end covering comprising a plate and a collar projecting perpendicularly from the plate;

the collar includes an outer surface and a radially inwardly extending stamped formation extending inwardly from the outer surface, the radially inwardly extending stamped formation conforming to dimensions of an inwardly projecting region of the overlapping side seam to receive at least a portion of the inwardly projecting region of the overlapping side seam therein; and the radially inwardly extending stamped formation opens outwardly.

20. The container of claim 19, wherein:

the at least one end covering comprises a bottom cover and a top cover.

* * * * *